US005758847A

United States Patent [19]

Corell et al.

[11] Patent Number: 5,758,847

[45] Date of Patent: Jun. 2, 1998

[54] CONTROL DEVICE FOR OVERHEAD CONVEYOR

[75] Inventors: Gerhard Corell, Garching; Dieter Braitmayer, Munich; Christoph Huber, Unterdeggenbach, all of Germany

[73] Assignee: Bayerische Motoren Werke Aktiengesellschaft, Germany

[21] Appl. No.: 516,703

[22] Filed: Aug. 18, 1995

[51] Int. Cl.[6] ..... B61L 27/00

[52] U.S. Cl. ..... 246/2 S; 246/167 D; 104/299; 340/903; 340/904

[58] Field of Search ..... 246/2 S, 167 D, 246/182 R, 182 B; 104/299, 300, 91; 340/903, 904, 942, 435

[56] References Cited

U.S. PATENT DOCUMENTS

| | | | |
|---|---|---|---|
| 3,365,572 | 1/1968 | Strauss | 246/167 D |
| 4,947,759 | 8/1990 | Uhl | 246/167 D |
| 5,037,045 | 8/1991 | Wakabayashi | 246/167 D |

FOREIGN PATENT DOCUMENTS

| | | | |
|---|---|---|---|
| 557962 | 9/1993 | European Pat. Off. | 246/2 S |
| 92 03 121.8 | 8/1993 | Germany . | |
| 5213200 | 8/1993 | Japan | 246/167 D |
| 661250 | 7/1987 | Switzerland | 246/167 D |

OTHER PUBLICATIONS

"Hochpräzise Geschwindigkeits–und Entfernungsmessungen –eine Methode und ihre Anwendungen," F. Leitl et al., messen + pprüfen/automatik Jan./Feb. 1983, pp. 40–47.

German Search Report dated Feb. 28, 1996.

*Primary Examiner*—S. Joseph Morano

*Attorney, Agent, or Firm*—Evenson, McKeown, Edwards & Lenahan, P.L.L.C.

[57] ABSTRACT

A control device for conveyor systems in an industrial area has a drive motor in each overhead conveyor, a drive control, and an associated sensor consisting of a transmitter aimed at the leading overhead conveyor and a receiver for the signal reflected by this overhead conveyor. The transmitter is configured to transmit a detection signal not only straight ahead, but also diagonally leftward and rightward ahead. The reflector is designed with a three dimensional reflecting surface contour, so that even with diagonal aiming toward the following overhead conveyor, the signal emitted from its transmitter is reflected at its receiver.

14 Claims, 5 Drawing Sheets

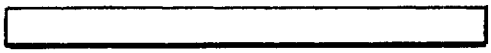
FIG. 4a
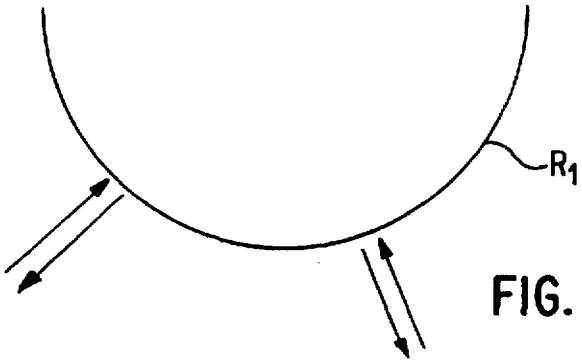
FIG. 4b
| NEAR/FAR | RIGHT | LEFT | |
|---|---|---|---|
| +24V | −24V | −24V | STRAIGHT-AHEAD TRAVEL, NEAR, ACTIVE |
| 0 V | +24V | +24V | STRAIGHT-AHEAD TRAVEL, FAR, ACTIVE |
| X | 0V | −24V | TRAVEL TO THE RIGHT, ACTIVE |
| X | +24V | 0V | TRAVEL TO THE LEFT, ACTIVE |
| X | 0V | 0V | TRAVEL TO THE RIGHT AND LEFT, ACTIVE |
FIG. 5

CONTROL DEVICE FOR OVERHEAD CONVEYOR

BACKGROUND AND SUMMARY OF THE INVENTION

The invention relates to a control device for an overhead conveyor system of the type in which a plurality of overhead conveyor units are transported along a predetermined track by individual drive motors. Spacing between consecutive conveyor units is maintained by means of a transmitter mounted on each conveyor unit, which detects the position of unit ahead.

A control device of this type is used, for example, for transporting partially assembled automobile bodies or the like along an assembly line in a factory. In the known systems, the transmitter on each conveyor unit is aimed straight ahead, and has a range of several meters. Such control device is suitable for a linear movement (that is, along a straight line) of the conveyor. Control of movement along a nonlinear segment of the track, for example on a curve, is accomplished by means of a block control. That is, the path of motion of the conveyor is divided into individual blocks, and the advance of a conveyor unit from each block into the next is possible only when the latter is free. Prior art arrangements for replacement of such block control by a control based on the spacing between consecutive conveyor units by means of a transmitter have been expensive and require a high assembly and installation cost.

One object of the present invention is to provide a simple and cost effective apparatus for controlling the movement of individually driven conveyor units along both linear and curved segments of a conveyor track.

Another object of the invention is to provide such a system in which each conveyor unit is independently controlled in response to output signals from a spacing sensor situated thereon.

Still another object of the invention is to provide such a system in which the transmitter unit associated with the spacing sensor of each conveyor unit is directionally selective, and can be actuated or aimed based on the path configuration of the conveyor track.

These and other objects and advantages are achieved by the conveyor system according to the invention in which each conveyor unit has a spacing sensor in the form of a transmitter which transmits a detection signal that is reflected by a reflector mounted on the back of the preceding conveyor unit. The receipt of a reflected detection signal thus indicates that the preceding conveyor unit is present within the illumination range of the spacing sensor. (When this happens, the drive to the following conveyor unit is interrupted, and is resumed only when the conveyor ahead has moved on.) According to the invention, each transmitter is capable of selectively transmitting signals not only to an area straight to the front of the conveyor unit, but also to lateral areas to the left and right of the front. Transmission of signals to the lateral areas is controlled by proximity switches which are actuated by triggering devices situated at points where the path of the track curves so that the appropriate area is thus illuminated.

By expanding the visual field of the invention into the lateral areas generally forward of the conveyor unit it is possible to use the spacing sensor such as described above, even on nonlinear sections of the conveyor track. At the same time, in order to accommodate the directional transmitter, which may transmit detection signals at differing angles relative to the conveyor unit ahead, it is necessary to adapt the design of the reflector (which reflects the transmitted signal from a transmitter to its associated receiver even when aimed diagonally). For this purpose, the reflector may have either a multifaceted or a curved design.

The detection signal can be transmitted optically (i.e., by visible or invisible light), or by ultrasound or by radio. It is advantageous for many applications to use a light signal for this purpose, since transmitters in the form of LEDs (light emitting diodes) are economical and electrically reliable, and also permit a good aiming effect.

The design of the transmitter can be such that the lateral areas are always illuminated by the detection signal, regardless of the shape of the path of motion. On the other hand, it is advantageous to aim the transmitter as a function of direction of the path followed by the conveyor track. That is, if the conveyor track is moving to the right or to the left, the transmitter is aimed to the right or to the left. This aiming is performed and continued until for example the overhead conveyor is again moving along a straight line.

Actuation of the directionally selective aiming of the transmitter can be performed by means of switches for each of the two directions. That is, as the conveyor track approaches a curved segment, a switch on the conveyor unit can be actuated to direct the transmitted detection signal to the right or left, as the conveyor unit passes by an activation unit situated adjacent the conveyor track. For this purpose, the switch in turn can operate mechanically or with zero contact (in the form of a proximity switch).

The reflector which is mounted at the rear of each conveyor unit can have various designs. For example, it is possible to provide the reflector with a plurality of surfaces at angles to one another. On the other hand, a clear improvement results when the reflector has a circular-cylindrical surface. This makes it possible to detect the presence of the leading conveyor from the following conveyor using the reflected signal, with an infinitely variable alignment of two successive conveyor units.

In addition, it is also advantageous to provide the transmitter with two or more transmission/detection ranges in the straight ahead direction. For example, in a preferred embodiment, the transmitter has alternative transmission modes of 1 and 5 meters to the front. This arrangement permits a rough differentiation of conveyor unit spacing in the straight ahead direction. That is, if there is no conveyor within the area illuminated by the longer range, the conveyor can be operated at higher speed. When a unit is detected ahead, by switching to the shorter range, the approach to this unit can be controlled so that the conveyor advances within the longer range but beyond the shorter range.

The selection of the ranges of 1 and 5 meters as noted above is of course merely an example. In fact, these ranges can be adjusted between 0.2 and 1.0 meters, and 2.0 and 5.0 meters respectively, or even beyond these ranges, depending on the character of the particular conveyor system.

The output signal from the spacing sensor can be fed to a control center that controls the motion of all the overhead conveyors. However, in a preferred embodiment, each conveyor operates independently; i.e., each spacing sensor is connected directly with the drive control of the conveyor unit on which it is mounted. This device then controls the drive motor only as a function of its "own" spacing sensor (independently of the drive control of the leading or following overhead conveyor), interrupting forward movement when the preceding conveyor unit is detected within the transmission range. In this manner the overall installation cost for the control device can be significantly reduced.

For such independent control of each overhead conveyor, it can be advantageous to connect the inputs of the drive control that receives signals from the spacing sensor in such fashion that each transmitter is activated when the corresponding input of the spacing sensor is not energized (that is, an input of 0 volts is received). Hence, this mode of operation corresponds to the state which prevails when the connecting electrical cable is broken or disconnected. In this manner the spacing sensor is activated to scan the lateral area in any case in the event of a defective connection.

The ability of the control device of the present invention to scan the path of motion of the conveyor in advance, even in the case of a curved path, and detect any overhead conveyors that might be present, makes it possible to adapt the control device flexibly to different paths of motion.

Other objects, advantages and novel features of the present invention will become apparent from the following detailed description of the invention when considered in conjunction with the accompanying drawings.

BRIEF DESCRIPTION OF THE DRAWINGS

FIGS. 4*a* and 4*b* are front and top views respectively of a reflector used in the control device according to the invention; and FIG. 5 is a table for explaining a safety measure for the operation of the system in FIG. 1.

DETAILED DESCRIPTION OF THE DRAWINGS

Figure 1:
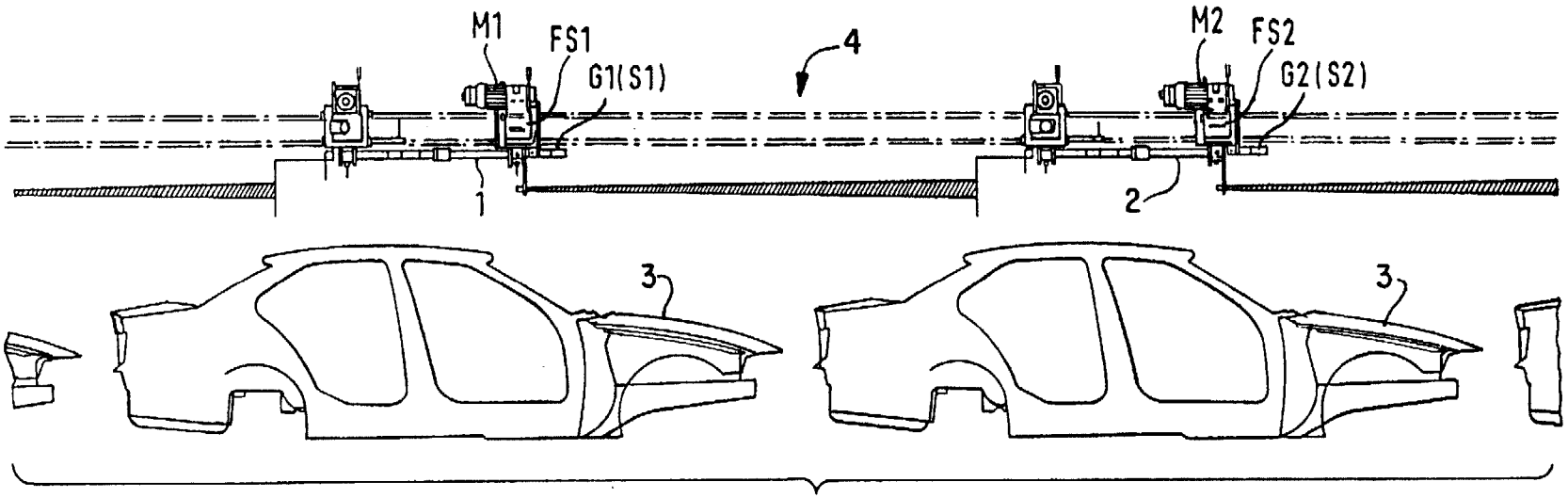
FIG. 1 shows a side view of a segment of an overhead conveyor system according to the invention.
Figure 2:
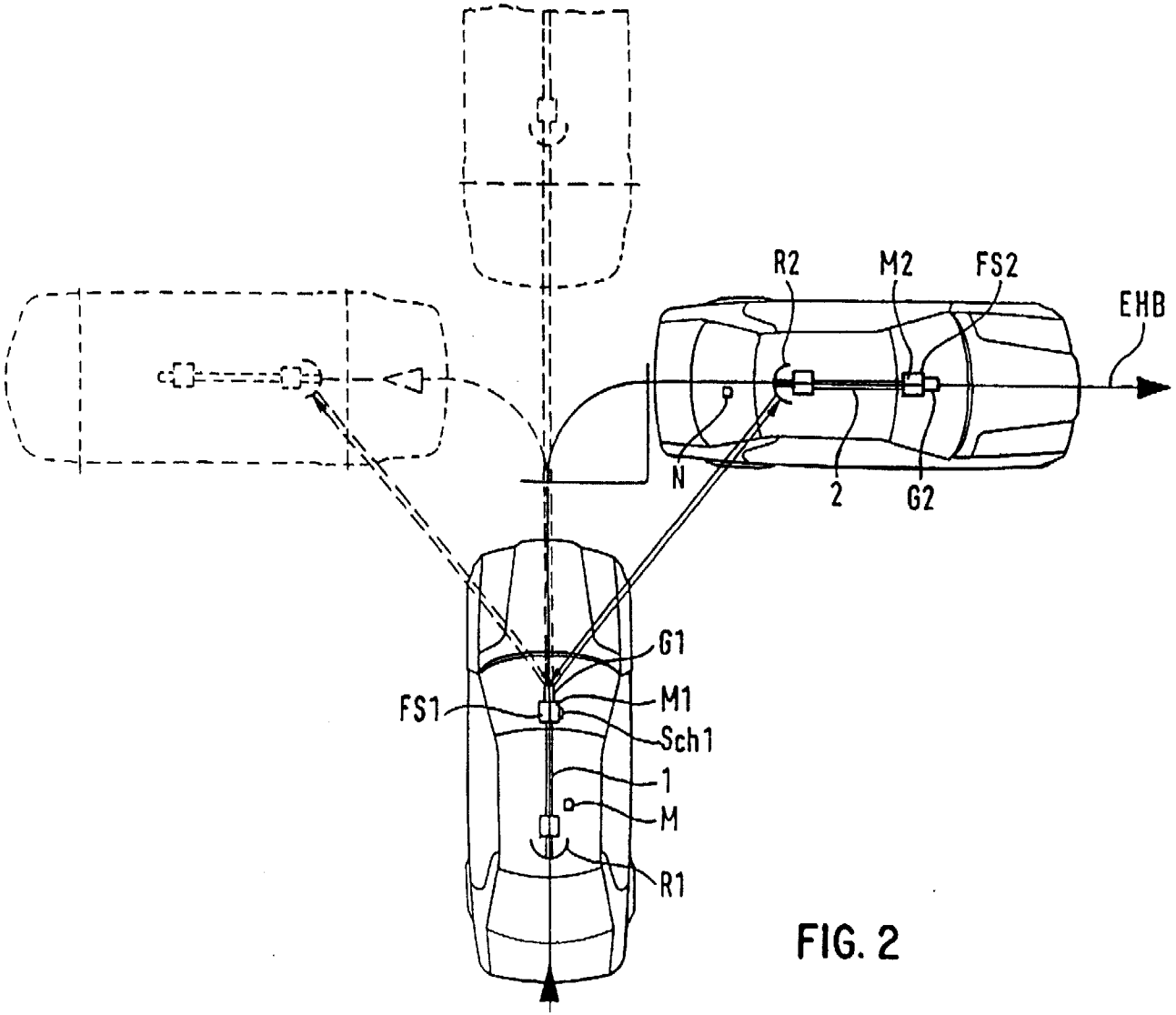
FIG. 2 shows a top view of the system in FIG. 1.

The overhead conveyor system shown partially in FIGS. 1 and 2 includes a plurality of conveyor units 1, 2 on which a part of a vehicle, in this case a vehicle body 3, is fastened in known fashion. In the particular example shown, the conveyor system comprises an overhead track 4, from which the vehicle bodies 3 are suspended. However, other configurations are possible, in which, for example, the conveyor units are mechanically or electrically guided along a track provided in a supporting surface, including a floor surface. Each conveyor unit 1 has a drive motor M1, M2 a drive control FS1, FS2, and a spacing sensor G1, G2. Each spacing sensor G1, G2, contains a transmitter S1, S2 with four individually actuatable transmit diodes and four receive diodes (not shown individually). Although two conveyor units 1, 2 are shown in FIG. 1, it is of course apparent that the overall conveyor system may comprise any number of conveyor units.

Figure 3A:
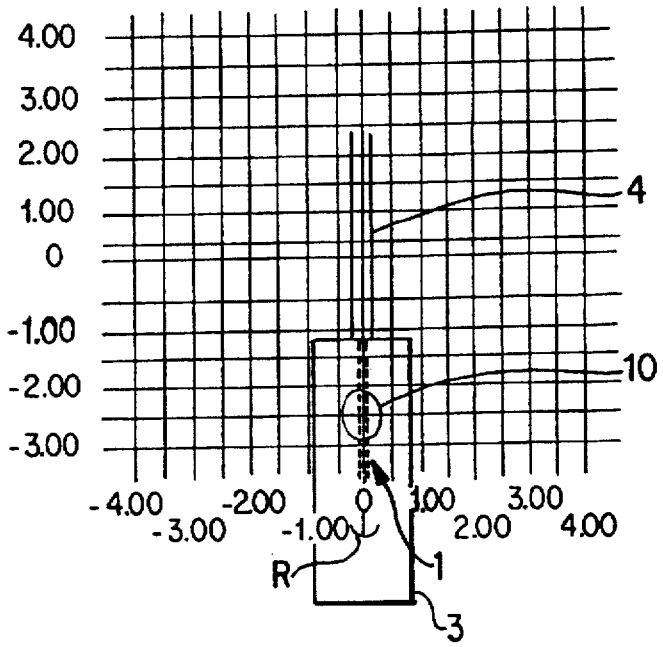
FIGS. 3A–3D show the theoretical mode of operation of the control device used in the systems of FIG. 1.
Figure 3B:
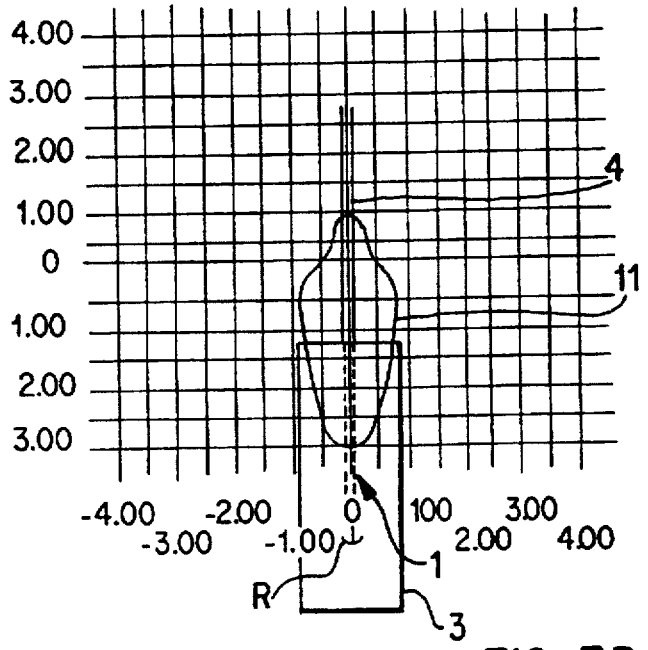

The various aiming alternatives of the four transmit diodes are illustrated diagrammatically in FIGS. 3A–3D, in which the transported vehicle body 3 is shown as a rectangle, and the areas 10–13 illuminated by the transmitter are indicated by a closed solid line. One transmit diode is aimed at the extension of the longitudinal axis of the overhead conveyor 1 and has a range of approximately one meter. The radiation characteristic pattern 10 of this diode is shown in FIG. 3A. A second transmit diode is aimed at an area that also runs in the lengthwise direction of the conveyor unit 1 and has a range of approximately 5 m, as shown by the radiation characteristic pattern 11 in FIG. 3B. Finally, there are two additional transmit diodes aimed to the right (FIG. 3C) and left (FIG. 3D) in the transmitter. Their ranges are about 7 m, and their radiation characteristic patterns 1, 13 are indicated.

FIGS. 3A–3D, also show the path followed by the conveyor track 4. The transmit diodes with the selectable radiation characteristic patterns shown in FIGS. 3A and 3B permit illumination of an area that is directly ahead, while transmit diodes with the patterns in FIGS. 3C and 3D make it possible to determine conveyor spacing on a right curve or a left curve respectively, when the conveyor ahead is located directly in and beyond the curved section of the path of motion.

In order to reflect the detection signal back to the spacing sensor of the conveyor unit from which it originated, each conveyor is provided with a rear mounted circular-cylindrical shaped reflector R1, R2 which is indicated schematically in the top view in FIG. 2. FIGS. 4*a* and 4*b* are enlarged schematic front and top views respectively of the same reflector, which is also shown for the leading overhead conveyor in FIGS. 3C and 3D. As indicated by the arrows in FIG. 4, it is apparent that such a reflector reflects the light signal emitted from the transmitter of the following conveyor back to its receiver, regardless of the angle from which it emanates. In this way the presence of a conveyor unit on the approaching conveyor track can be detected.

Figure 3C:
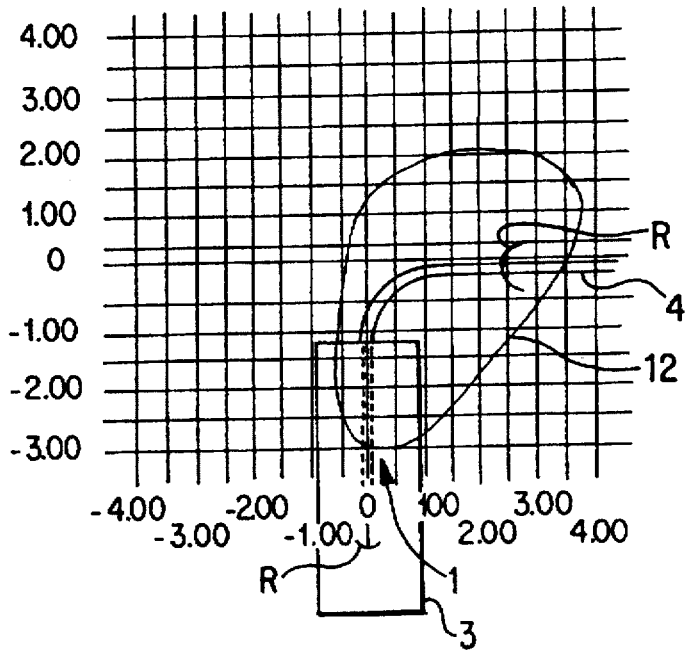
Figure 3D:
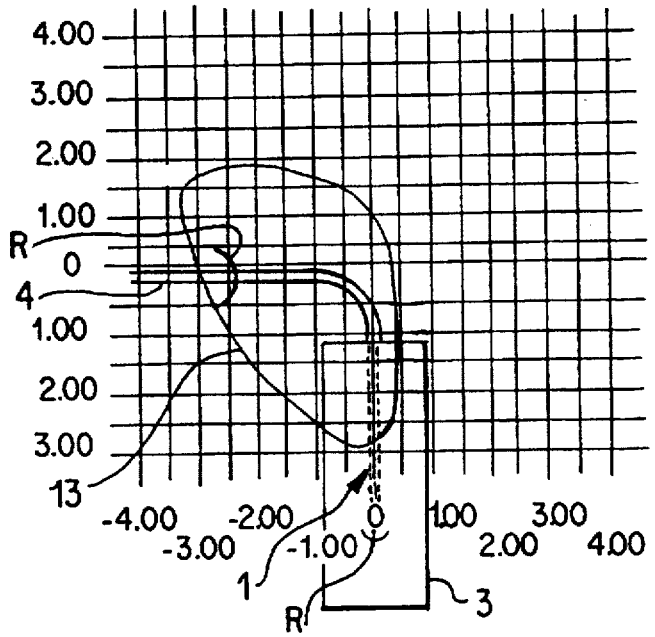

The activation of the transmit diodes for lateral aiming is accomplished with the aid of proximity switches. For this purpose for example, magnetic latching switches can be located on the right and left side of each conveyor unit, which switches are actuated by magnets located adjacent the conveyor track in the vicinity of approaching curved segments, on its right or left side, depending on the direction of the curve. In FIG. 2 one magnet M, and a magnetic latching switch Sch1 on overhead conveyor 1, are shown. Upon passing the magnet M, switch Sch1 is actuated and the transmitter is switched to transmit to the right front, as depicted in FIG. 3C. After passing through the curve the transmitter is once again switched to aim straight ahead by another magnet N.

With the aid of spacing sensors G1, G2 it is possible to directly control the corresponding drive motor M1, M2 through the drive control FS1, FS2. No central control is required, it being necessary merely to provide a power supply for each drive motor and the corresponding spacing sensor.

Since the transmit diodes located in transmitters S1, S2 are actuated by the magnetic latch switch, the circuit is chosen so that if a control lead to the switch fails (that is, experiences an open circuit or a ground fault), the associated transmit diode is activated.

This is shown by the truth table in FIG. 5. Each of the transmit diodes is controlled by an input whose occupation by a potential (24 volts) is indicated in the table in FIG. 5. (An X indicates either 0 volts or 24 volts.) In order to avoid collisions between the overhead conveyors if an electrical control cable should break or become disconnected (thus providing an input of 0 volts), the input for straight-line travel are set to the high-active mode and the inputs for travel on curves are activated on both the right and left. As a result assurance is provided that in the event of a failure in the control lines, the sector with the largest scanning range will always be activated. For this purpose the input of the spacing sensor is connected to OV by a pull-down resistance (not shown). If a cable should break, the spacing sensor switches to "remote active." If two diodes for near/far acquisition are provided in the sensor, they are always detected by the potential on the control input.

Although the invention has been described and illustrated in detail, it is to be clearly understood that the same is by way of illustration and example, and is not to be taken by way of limitation. The spirit and scope of the present invention are to be limited only by the terms of the appended claims.

What is claimed is:

1. Control apparatus for a conveyor system having a plurality of conveyor units, each of which has a drive motor for propelling it along a conveyor track, said control apparatus comprising:

a transmitter adapted to be mounted on each of said conveyor units for transmitting a detection signal to detect a next preceding conveyor unit on said conveyor track;

a reflector adapted to be mounted at a rearward end of each of said conveyor units for reflecting said detection signal back to a conveyor unit from which it was transmitted;

a receiver adapted to be mounted on each of said conveyor units for receiving reflected detection signals from the next preceding conveyor unit; and a drive control unit for controlling said drive motor of each of said conveyor units in response to reflected detection signals from a the next preceding conveyor unit;

wherein said transmitter unit is actuatable to transmit said detection signal in a variable direction which is selectable to be in one of three different directions, said directions being straight ahead with respect a longitudinal axis of said conveyor unit, diagonally ahead to an area to the left adjacent said longitudinal axis, and diagonally ahead to an area to the right adjacent said longitudinal axis; and wherein said reflector units have a three dimensional reflecting surface contour.

2. Control apparatus according to claim 1, wherein said reflector has a multifaceted reflecting surface contour for reflecting detection signals in a plurality of directions.

3. Control apparatus according to claim 1, wherein said reflector has a circular cylindrical reflecting surface contour for reflecting detection signals in an infinitely variable direction.

4. Control apparatus according to claim 3, wherein a longitudinal axis of said cylindrical reflecting surface contour is perpendicular to a plane of said conveyor track.

5. Control apparatus according to claim 1, wherein said transmitter is selectively actuatable in response to presence of curves in a path of said conveyor track, to transmit the detection signal in a direction of said curves of said conveyor track.

6. Control apparatus according to claim 5, further comprising actuators for selectively actuating said transmitter, said actuators being situated adjacent said path of said conveyor track at points before and after curved portions thereof.

7. Control apparatus according to claim 6, wherein said transmitter comprises proximity switches for controlling a direction of transmission thereof, and said actuators generate a switching signal which actuates said proximity switches as they pass on said conveyor track.

8. Control apparatus according to claim 7, wherein said switching signal is a magnetic field.

9. Control apparatus according to claim 8, wherein said actuators are magnets.

10. Control apparatus according to claim 7, wherein said transmitters comprise a plurality of light emitting diodes aimed respectively at least straight ahead, diagonally to the left front and diagonally to the right front, said light emitting diodes being selectively energizable, by said proximity switches.

11. Control apparatus according to claim 1, wherein said transmitters comprise a plurality of light emitting diodes aimed respectively at least straight ahead, diagonally to the left front and diagonally to the right front, said light emitting diodes being selectively energizable.

12. Control apparatus according to claim 1, wherein lateral aiming of the transmitter takes place as a function of the energization of control inputs that are activatable to deactivate the aiming.

13. Control apparatus according to claim 1, wherein an additional partial transmitter is aimed at an area that lies at a greater distance ahead of the respective overhead conveyor.

14. A conveyor system having a plurality of conveyor units, each of which has a drive motor for propelling it along a conveyor track and a control apparatus for controlling said conveyor units, said control apparatus comprising:

a transmitter mounted on each of said conveyor units for transmitting a detection signal to detect a next preceding conveyor unit on said conveyor track;

a reflector mounted at a rearward end of each of said conveyor units for reflecting said detection signal back to a conveyor unit from which it was transmitted;

a receiver mounted on each of said conveyor units for receiving reflected detection signals from the next preceding conveyor unit; and a drive control unit for controlling said drive motor of each of said conveyor units in response to reflected detection signals from a the next preceding conveyor unit;

wherein said transmitter unit is actuatable to transmit said detection signal in a variable direction which is selectable to be in one of three different directions, said directions being straight ahead with respect a longitudinal axis of said conveyor unit, diagonally ahead to an area to the left adjacent said longitudinal axis, and diagonally ahead to an area to the right adjacent said longitudinal axis; and wherein said reflector units have a three dimensional reflecting surface contour.

* * * * *